United States Patent [19]

Scheitza

[11] Patent Number: 4,876,878

[45] Date of Patent: Oct. 31, 1989

[54] PRESS WITH HYDRO-MECHANICAL DRIVE

[75] Inventor: Andrea Scheitza, Weiterstadt, Fed. Rep. of Germany

[73] Assignee: Werner Leinhaas, Gelnhausen, Fed. Rep. of Germany

[21] Appl. No.: 172,696

[22] Filed: Mar. 23, 1988

[30] Foreign Application Priority Data

Mar. 24, 1987 [EP] European Pat. Off. ..... 87104278.4

[51] Int. Cl.[4] ..... B21J 9/18

[52] U.S. Cl. ..... 72/450; 72/455; 83/630; 100/286

[58] Field of Search ..... 72/450, 451, 455, 456; 100/283, 286, 257; 83/530, 630; 74/520, 603

[56] References Cited

U.S. PATENT DOCUMENTS

| | | | |
|---|---|---|---|
| 3,205,551 | 9/1965 | Neubauer et al. | 100/286 |
| 3,208,373 | 9/1965 | Bachelier | 100/286 |
| 3,611,497 | 10/1971 | Gidge et al. | 100/286 |
| 3,682,029 | 8/1972 | Haas et al. . | |
| 3,866,503 | 2/1975 | Gal . | |
| 4,160,409 | 7/1979 | Portmann . | |
| 4,302,961 | 12/1981 | Leinhaas | 72/451 |
| 4,318,325 | 3/1982 | Bareis et al. . | |
| 4,419,929 | 12/1983 | Dommer et al. | 83/630 |
| 4,660,452 | 4/1987 | Leinhaas | 83/630 |

FOREIGN PATENT DOCUMENTS

| | | | |
|---|---|---|---|
| 2925416 | 2/1983 | Fed. Rep. of Germany . | |
| 0683836 | 9/1979 | U.S.S.R. | 72/450 |
| 804352 | 11/1958 | United Kingdom . | |

OTHER PUBLICATIONS

VDI-Report No. 614, 1986, pp. 297-306, "Die Differenzwegpresse-Einsatzmoglichkeiten und Vorteile".

Blech Rohre Profile 31 (1984) 3, Meisenbach KG, D-8600 Bamberg 1, "Stanzen von Bohrungen kleinerer Materialstarke und in Feinschneidqualitate".

Blech Rohre Profile, (1984), "Feinschneiden auf der Differenzwegpresse".

Blech Rohre Profile 32 (1985) 11, Meisenbach KG, D-8600 Bamberg 1, "Herstellung von Prageteilen auf der Differenzwegpresse".

Blech Rohre Profile 33 (1986) 10, Meisenbach GmbH, D-8600 Bamberg 1, "Gengenlaufige Differenzwegpresse eroffnet neuartige Umformtechniken".

H. Mekel, "Mechanische Pressen", Carl Hanser-Verlag (1961), Seite 33.

Leinhaas: Ohne Handgriff vom Band bis zum Fertigteil Schnell und genau fertigen im Blechumformverbund (1984).

*Primary Examiner*—David Jones

*Attorney, Agent, or Firm*—Marmorek, Guttman & Rubenstein

[57] ABSTRACT

The invention relates to a cutting and reshaping press with hydro-mechanical articulated lever drive in which a drive cylinder (3) for a ram (2) is supported by a bridge structure (5) located in a stanchion (1) between lateral guides (12). The bridge structure (5) is connected to the stanchion (1) by means of threaded spindles (4) capable of being adjusted in height. The bridge structure (5) constitutes the connection between two support axles (6) installed on either side symmetrically in relation to the middle of the press and a central guide (7) in which the piston rod (3.1) travels. At the end of piston rod (3.1) is an articulation point (10.4). The two support axles (6), together with additional connected articulation points (8 and 9) constitute rigid triangles (10) which are pivotable about support axles (6). The articulation point (9) oriented towards the center of the ram (2) is connected by two coupled drive lever elements (10.2 and 10.2) to articulation point (10.3) located in curves (7.1) and articulation points (10.4) in the central guide (7).

8 Claims, 3 Drawing Sheets

PRESS WITH HYDRO-MECHANICAL DRIVE

BACKGROUND OF THE INVENTION

The instant invention relates to a cutting and reshaping press with a hydro-mechanical articulated lever drive in which the drive cylinder of a ram is supported by a bridge structure located in the stanchion between lateral guides. The ram is connected to the stanchion by means of threaded spindles or other means capable of being adjusted in height, the bridge construction thereby being adjustable within the free space formed within the frame-shaped stanchion.

German Pat. No. 29 25 416 discloses an articulated lever press to cut sheet metal. The structure disclosed therein comprises a "differential-path" press having a pressure cylinder drive located between two articulated-lever systems. The drive's piston engages by the end of its piston rod a connection articulation comprising two control arms in the middle of the press. The piston is linked by its other end to the articulated lever systems (the articulations of said articulated-lever systems bending outward to point to the middle of the press and being symmetrical in relation to said middle), whereby the connection articulation, assisted by the press ram, is provided with a guidance transversely to the direction of the piston rod. The press is characterized in that the support for the pressure cylinder drive is on the press ram. The ram may be fashioned in the form of a frame.

U.S. Pat. No. 2,087,811 and British Pat. No. 804,352 were indicated therein as the authoritative state of the art. According to these published patents the stroke path of the ram is defined by the stroke of the fixed drive cylinder attached to the frame and by the multiplication ratio which results in a known manner from the articulated-lever drive and from the type of control arm used.

The development of the differential-path press begun by the applicant some 10 years ago has proven itself very well as the publications listed at the end of the description testify.

The observations made and especially the intensive investigation of over 100 completed differential-path presses which have given top performance in the most varied types of reshaping techniques lead however to the conclusion that, while essential advantages over the classic press systems are proven beyond doubt, several significant changes in the system seem advisable in the interest of even greater improvements.

The following individual facts were taken into consideration:

a. Ram Speed

Investigations have shown that the differential-path press has a high idling speed and a very slow forming speed.

The resulting advantages have been described in the cited publications, but internal investigations and experience gained in the field led to the conclusion that the retardation attained in the differential-path press which is 8 or 10 times that of an eccentric press, yields truly good results but that conversely no retardation beyond this length is necessary.

Forming over the 5 times greater area of an "eccentric press" finally has the same effect and offers a shorter rhythmic sequence.

In addition it was also shown that the high idling speed, especially during the back stroke, does not tolerate any additional increase in the number of strokes because of the very long braking path of the ram in the upper dead center, i.e. the stroke capacity of the differential-path press is approximately 10 to 20% below that of an eccentric press. Added to this is yet another handicap in case of an automated press as insufficient time is available for the automation equipment so that the press is slowed down overall as a result because it must always wait for the completion of the operations of these items of equipment which are as a rule operated in a sequence that is under constrained control. On the other hand the significant advantages of the differential-path press appear clearly, even with only five times the reshaping range of the eccentric press.

A comparison between velocity sequences of the eccentric press, of the differential-path press and of the press according to the instant invention confirms this clearly (see FIG. 4).

(b) Progression of forces as a function of distance from the lower dead center

It was found that the differential-path press has a much greater work capacity at a rating equal to that of a comparable eccentric press because it does not work on drive force.

The progression of its pressure force in the lower dead center lies, depending upon the manufacturer, usually above that of an eccentric press, however the curve decreases more rapidly than for an eccentric press as the distance from the lower dead center increases.

For this reason, the progression of the curve of the pressure as a function of the distance from the lower dead center should be raised in the intended new development, and in order to achieve this it is no longer possible to avoid modifying the system.

In this context it must be noted that the differential-path press was developed on the basis of considerations that the hydraulic cylinder participates in the stroke of the ram, resulting in approximately 25% energy savings.

It was found however that the great advantage of this press can also lead to considerable tilting movements of the hydraulic cylinder when an eccentric load is applied because of the distance between the lower edge of the ram, the suspension point and the cylinder fastening, and such movements may often provoke a rupture of the piston rod or of the piston rod fastening as the central piece is then guided separately in the frame so that tensions cannot always be absorbed in this area when eccentric loads apply.

When the differential-path press is used as a stamping press it is also possible to attain die tool lives 30 times longer than is the case with a spindle press although large-size bearings are required. It is however not possible to enlarge these bearings, if only because of space availability considerations in differential-path presses.

Based on these considerations it is the objective of the instant invention to define a press of the type described initially herein with velocity characteristics that make it possible to achieve a slower idling speed, better and more precise braking capability and thereby better controllability and an increased number of strokes, whereby the pressure multiplication ratio is selected in relation to that of the differential-path press so that the stroke of the drive cylinder is considerably greater than the stroke of the ram.

SUMMARY OF THE INVENTION

The solution to achieve this objective according to the invention provides for a press having a bridge structure which constitutes a connection between the bearing axles located on either side, symmetrically in relation to the center of the press. The device also includes a central piston-rod guide including its limit defined by the articulation point to receive the drive cylinder, for the two bearing axles together with additional connected articulation points to constitute a rigid triangle that is capable of swivelling, said triangle's articulation point towards the ram center leading via two coupled drive lever elements to the articulation point connected to the articulation points capable of being moved in direction of the central guide and for the articulation points located on either side in the lower zone of the central guide to continue on either side into a separate curve and for the articulation points of the triangle to be connected to the ram by a continuing lever element.

Thanks to the fixed arrangement of the stroke cylinder on a bridge structure which holds the suspension bearings and the central guide for the piston rod, whereby the position of said bridge structure can be adjusted in relation to the machine stanchion so as to take into account the installation height of the tool to a great extent, further applications of the press are made possible, whereby the adjustable connection between stanchion and ram prevents in advance any tilting of the drive cylinder or of its piston rod so that the system is no longer endangered.

The pivotable connection further provided between the two articulation points and a rigid, pivotable triangle not only simplifies but also enhances the precision of the guide, whereby the central guide divides into two curves with U-shaped cross-section. Security of guidance is increased and friction losses are reduced thanks to the branching-off U-shaped guidance of the articulation points on either side, so that the pressure can be applied to the ram in multiplication of the drive elements The articulation point of the triangle pointing to the center of the press results in ideal, more even movements of the cylinder piston rod than does the connection provided with differential-path presses.

In the lower zone the guide curve transforms the unnecessary but still present force into speed.

It should further be pointed out that a design whereby the overall multiplication is such that the stroke of the drive cylinder is approximately twice that of the ram stroke has been found to be advantageous.

This multiplication ratio may be varied from case to case.

The instant invention is described in greater detail through the enclosed drawings of illustrative examples of the system according to the invention.

DETAILED DESCRIPTION

Figure 1:
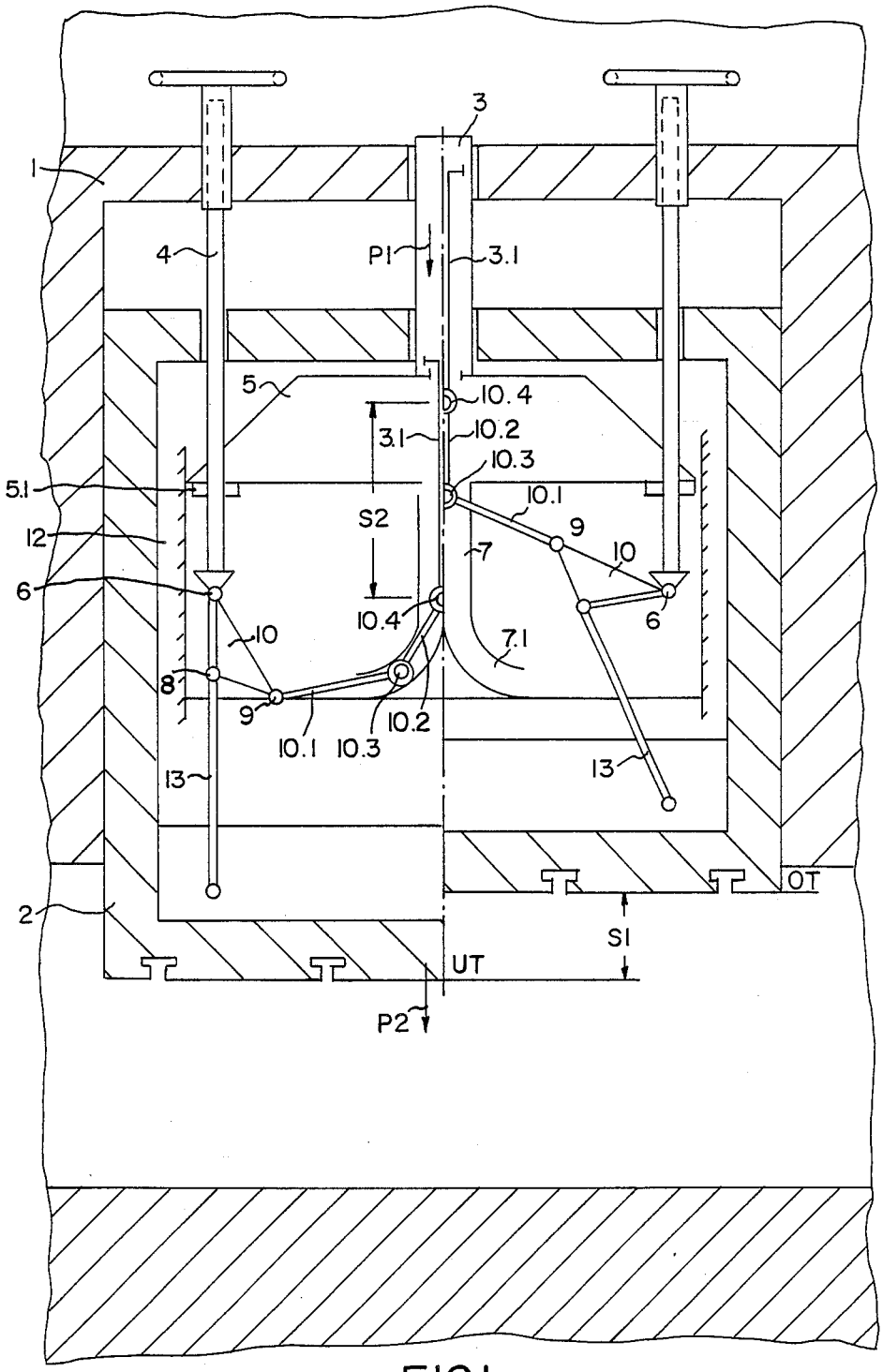
FIG. 1 is a representation, in connected cross-sections, of the lower dead center position on the left side and of the upper dead center position on the right side of the ram in which the possibility of height adjustment of the bearing bridge structure by means of spindles as well as the arrangement and the guidance of the articulation levers towards the ram can be recognized.
Figure 3:
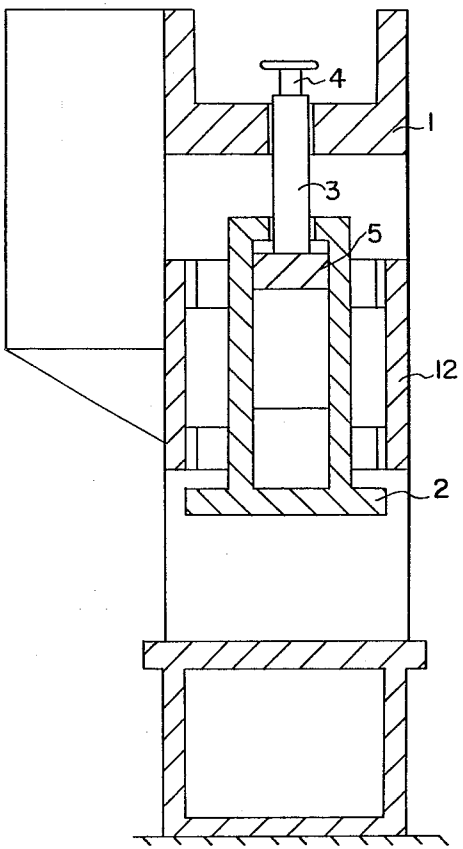
FIG. 3 shows a cross-section of FIG. 2, i.e., essentially a side view.
Figure 2:
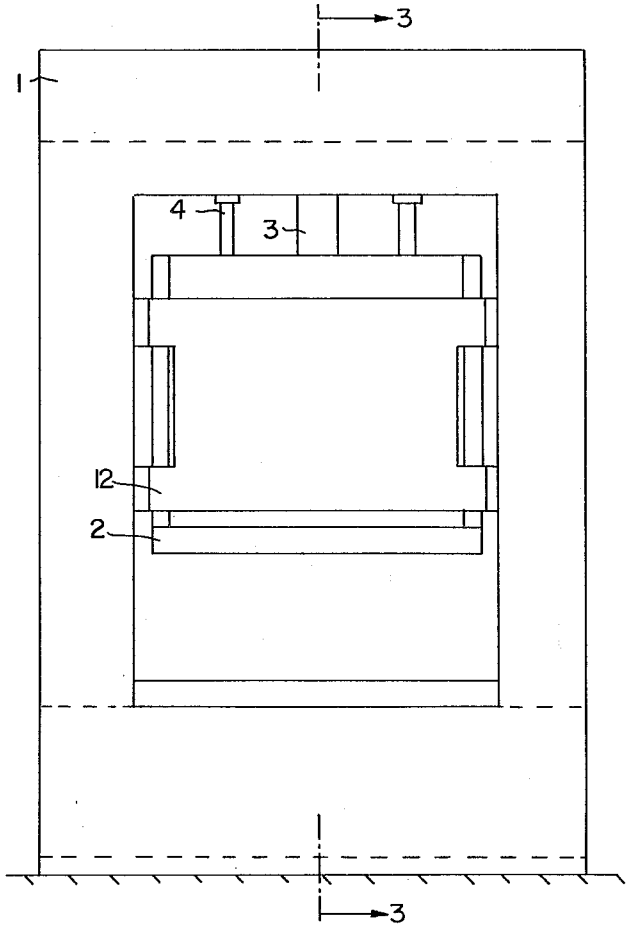
FIG. 2 is a front view of the press.
Figure 4:
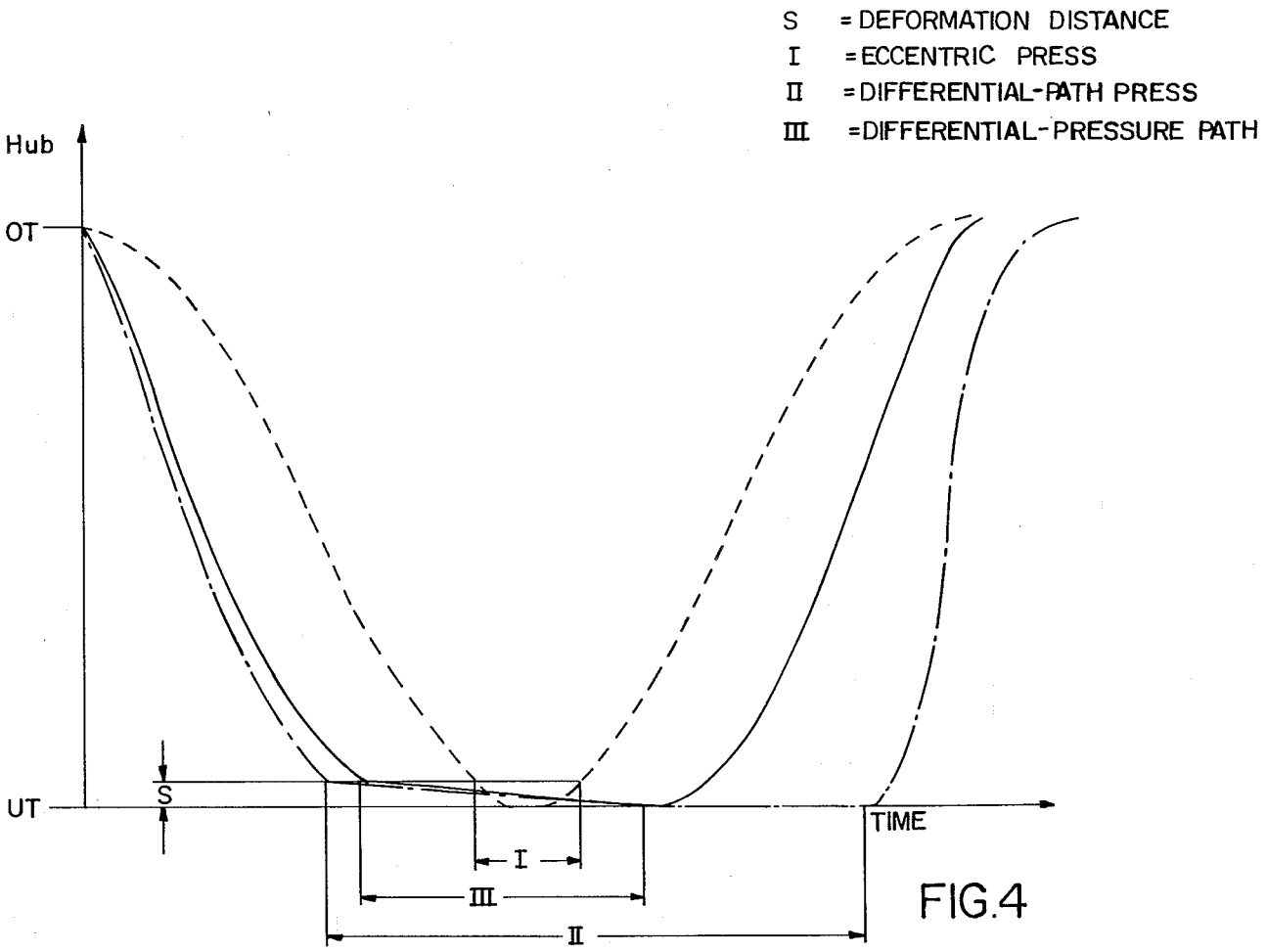
FIG. 4 shows the forming paths of different types of presses, curve I representing an eccentric press, curve II representing a differential-path press and curve III representing the differential-pressure press of the present invention.

A frame-shaped press ram 2 is located inside a free space of stanchion 1 and is bounded by the upper edge of the press table and the lower limit of the upper cross-yoke as well as by the two lateral, adjustable guides 12. The press ram 2 is otherwise connected to a bridge structure 5 holding the drive cylinder 3, said bridge structure 5 being capable of being adjusted in height in relation to stanchion 1 by means of the threaded spindles 4. Bridge structure 5 is reinforced in receiving spindles 4 by extensions of guide 5.1.

In the area between its lateral and lower boundaries, the bridge structure 5 holds on both sides bearing axles 6 which function as fixed, support points of the pivotable triangles 10 which are further defined by the movable articulation points 8 and 9. On either side the articulation points 8 are upper and lower portions of the connecting lever 13. The upper portion 13A of lever 13 is connected to the fixed bearing axle 6 and to movable articulation point 8, while the lower portion 13B is connected to movable articulation point 8 and to fixed support point 14 of ram 2.

Each articulation point 9 is connected by a lever element 10.1 to another articulation point 10.3, while articulation point 10.3 is connected to yet another articulation point 10.4 by means of lever 10.2. The articulation points 10.3 and 10.4 are made in the form of easily rotating rollers, for example, roller bearing which travel in U-shaped tracks or guides 7.

The articulation points 8, 9, 10.3 and 10.4 on the connecting levers 13A, 13B, 10.1, and 10.2 provide an articulated bending as shown on the right side of FIG. 1. Furthermore each of the articulation levers 10.2 is connected to an articulation point 10.4 which slides in the central guide 7 and is connected to the end of piston rod 3.1.

Starting at this articulation point 10.4, as shown on the right side of FIG. 1, the articulation points 10.3 are driven via corresponding lever elements 10.2 when piston 3 is hydromechanically driven. Each of the articulation points 10.3 is guided in a separate curve 7.1 of U-shaped cross-section and is connected to the articulation points 9 of the triangles 10 via the lever elements 10.1. The articulation points 8 and 9 move towards the positions shown on the left side of FIG. 1, whereby the triangles 10 pivot about fixed support 6. Because the point 6 is fixed to stanchion 1 (once the height has been adjusted by spindles 4), and because the point 14 is fixed to ram 2, ram 2 will be caused to move relative to stanchion 1 as show in FIG. 1. Thus, the large movement $S_2$ of piston 3 has been converted to the smaller movement $S_1$ of ram 2.

List of the publications previously mentioned (A) VDI—Report No. 614, 1986, pages 297–306 "Die Differenzwegpresse—Einsatzmoglichkeiten und Vorteile"

(B) Reprint from the technical publication Blech Rohre Profile 31 (1984) 3, Meisenbach KG, D-8600 Bamberg 1 "Stanzen von Bohrungen kleinerer Materialstarke und in Feinschneidqualitat"

(C) Reprint from the technical publication Blech Rohre Profile, "Feinschneiden auf der Differenzwegpresse"

(D) Reprint from the technical publication Blech Rohre Profle 32 (1985) 11, Meisenbach KG, D-8600 Bamberg 1 "Herstellung von Prageteilen auf der Differenzwegpresse"

(E) Reprint from the technical publication Blech Rohre Profile 33 (1986) 10, Meisenbach GmbH, D-8600 Bamberg 1 "Gengenlaufige Differenzwegpresse eröffnet neuartige Umformtechniken"

(F) Advertising publication of the company LEINHAAS GmbH "Ohne Handgriff vom Band zum Fertigteil" (Schnell und genau fertigen im Blechumformverbund)

I claim:

1. A cutting and reshaping press, comprising a frame comprising a top plate, a base plate and vertical supports extending between said top plate and said base plate, said frame having a substantially hollow interior region, a press ram comprising a top wall, a bottom wall and sidewall extending between said top wall and said bottom wall, said press ram including a substantially hollow interior region, said press ram being located within said hollow interior region of said frame and being movable relative to said frame, adjustable suspension means connecting said top wall of said press ram to said top plate of said frame, said adjustable suspension means passing through said top wall and extending into the interior region of said press ram, a drive system located between said top wall of said press ram and said top plate of said frame, said drive system passing through said top wall and extending into the interior region of said press ram, said drive system including a piston, a central guide located substantially centrally of said topwall and extending into the interior region of said press ram, said piston travelling within said central guide, a support axle located at a second end of said suspension means within the interior region of said press ram, a bridge structure located within the interior region of said press ram and connecting said central guide to said suspension means, first, second and third movable articulation points located within the interior region of said press ram, first coupling means comprising first, second, and third levers connecting said support axle, said first articulation point, and said second articulation point into a rigid triangle pivotable about said support axle, second coupling means comprising a fourth lever connecting said first articulation point to said bottom wall of said press ram, and third coupling means comprising a fifth lever connecting said second articulation point to said third articulation point, said third articulation point being attached to said piston and travelling within said central guide along with said piston, wherein movement by said piston through a distance $S_2$ causes said press ram to move a distance $S_1$ relative to said frame, said distance $S_1$ being less than said distance $S_2$.

2. The press of claim 1 comprising dual suspension means, dual support axles, dual first, second and third articulation points, dual first, second, and third coupling means, all of said dual systems being symmetrically disposed about said central guide.

3. The press of claim 2 further comprising a fourth movable articulation point between said second and third articulation points.

4. The press of claim 3 wherein said fifth lever connects said second articulation point to said fourth articulation point, and said third coupling means further comprises a sixth lever connecting said third articulation point to said fourth articulation point.

5. The press of claim 4 wherein said central guide includes a curved portion, said fourth articulation point travelling in said curved portion of said central guide.

6. The press of claim 5 further comprising lateral guides connected to said bridge structure.

7. The press of claim 1 wherein said fourth articulation point comprises a rotatable roller.

8. The press of claim I wherein said distance $S_2$ is about twice the distance of $S_1$.

* * * * *